US006655909B2

(12) United States Patent
Yu et al.

(10) Patent No.: US 6,655,909 B2
(45) Date of Patent: Dec. 2, 2003

(54) HIGH FLOW FUEL PUMP

(75) Inventors: DeQuan Yu, Ann Arbor, MI (US); Sheven Sharp, Madison Hts., MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 124 days.

(21) Appl. No.: 09/997,370

(22) Filed: Nov. 30, 2001

(65) Prior Publication Data

US 2003/0103841 A1 Jun. 5, 2003

(51) Int. Cl.[7] ..... F04D 5/00
(52) U.S. Cl. ..... 415/55.1; 415/119; 415/169.1
(58) Field of Search ..... 415/55.1, 55.2, 415/55.3, 55.4, 55.5, 55.6, 55.7, 119, 169.1

(56) References Cited

U.S. PATENT DOCUMENTS

| | | | | |
|---|---|---|---|---|
| 5,024,578 A | | 6/1991 | Vansadia | |
| 5,284,417 A | | 2/1994 | Yu | |
| 5,330,319 A | | 7/1994 | Yu et al. | |
| 5,336,045 A | | 8/1994 | Koyama et al. | |
| 5,375,975 A | * | 12/1994 | Yu et al. | 415/55.1 |
| 5,413,457 A | | 5/1995 | Tuckey | |
| 5,486,087 A | | 1/1996 | Treiber et al. | |
| 5,531,835 A | | 7/1996 | Fodor et al. | |
| 5,551,835 A | | 9/1996 | Yu et al. | |
| 6,010,301 A | * | 1/2000 | Oi et al. | 415/55.2 |
| 6,116,850 A | | 9/2000 | Yu | |
| 6,152,687 A | | 11/2000 | Wilhelm et al. | |
| 6,527,506 B2 | * | 3/2003 | Pickelman et al. | 415/55.1 |
| 6,547,515 B2 | * | 4/2003 | Ross | 415/55.1 |

FOREIGN PATENT DOCUMENTS

| | | |
|---|---|---|
| GB | 2 263 503 | 7/1993 |

* cited by examiner

*Primary Examiner*—Christopher Verdier
(74) *Attorney, Agent, or Firm*—Brinks Hofer Gilson & Lione

(57) ABSTRACT

A fuel pump includes a pump housing with a motor which is adapted to rotate a shaft with a ring impeller mounted thereon. A bottom is mounted to the housing and has an outlet. A cover is mounted on an end of the housing and is attached to the bottom with the ring impeller enclosed between the cover and the bottom. The cover includes a first side having a fuel inlet orifice and a second side having a flow channel formed therein. The inlet orifice extends through the cover in fluid communication with the flow channel. The flow channel includes an inlet, a ramp, a ramp end and a main channel. The inlet includes a smooth curved profile. The ramp connects the inlet to the ramp end. The ramp end connects the ramp to the main channel.

40 Claims, 3 Drawing Sheets

HIGH FLOW FUEL PUMP

TECHNICAL FIELD OF THE INVENTION

The present invention generally relates to an automotive fuel pump for use with an automobile engine.

BACKGROUND OF THE INVENTION

The regenerative fuel pump with a ring impeller is well known in the industry especially for lower voltage, high pressure applications. However, this type of fuel pump has disadvantages when used in higher flow, hot fuel applications. For proper performance, it is desirable that the pump supply only liquid fuel to the fuel injectors of the automobile. Ring impeller pumps when used in high flow, hot fuel applications tend to generate fuel vapors due to the high turbulence of the high pressure flow. When the fuel is hot, the fuel will more easily transform into vapor, thereby compounding the vapor problem.

Traditional pumps, such as those described in U.S. Pat. Nos. 5,024,578 and 5,336,045 have attempted to resolve this problem by increasing the width of the flow channel within the fuel pump, expanding the flow channel outward radially. This does not solve all the concerns however, because the flow channel cannot extend outward beyond the radius of the ring impeller. Additionally, the '045 patent and the '578 patent also describe a flow channel with increased depth. This flow channel profile is only useful for relatively lower flow rates of about 100 liters per hour. The wider and deeper flow channel concepts do not solve the vapor concerns in a high flow ring impeller application. Therefore, there is a need for an improved ring impeller fuel pump suitable for high flow and hot fuel handling situations.

DETAILED DESCRIPTION OF THE PREFERRED EMBODIMENT

The following description of the preferred embodiment of the invention is not intended to limit the scope of the invention to this preferred embodiment, but rather to enable any person skilled in the art to make and use the invention.

Figure 1:
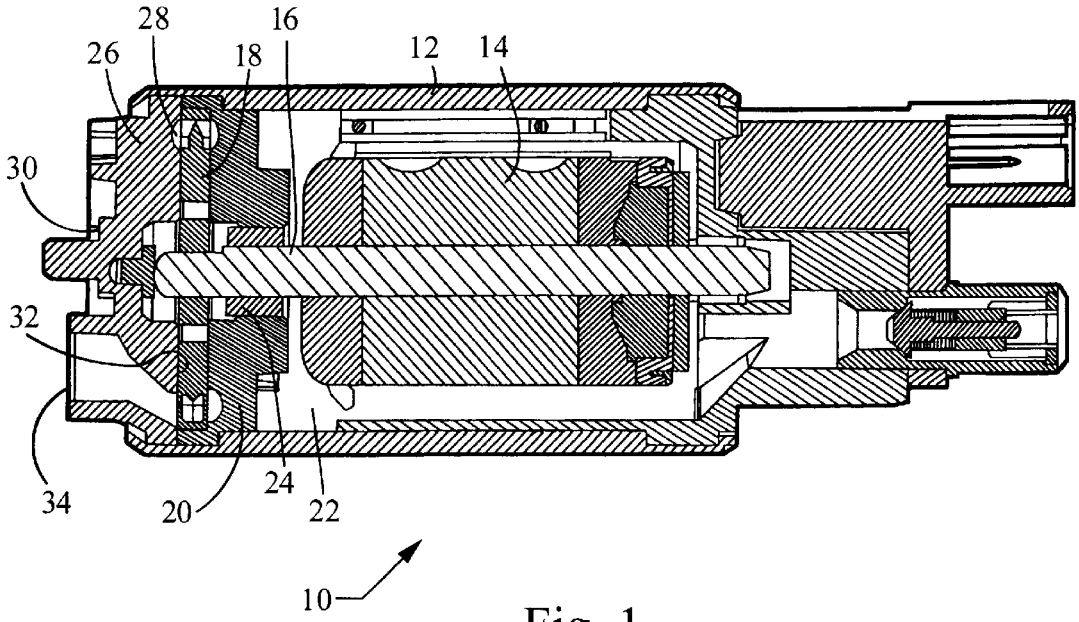
FIG. 1 is a side sectional view of a fuel pump of the present invention.

Referring to FIG. 1, an embodiment of the pump of the present invention is shown generally at 10. The pump 10 includes a pump housing 12 for containing the internal components of the pump 10. A motor 14 is mounted within the pump housing 12. The motor 14 includes a shaft 16 extending therefrom and is adapted to rotate the shaft 16. Preferably, the motor 14 is an electric motor. A ring impeller 18 is fixedly attached to the shaft 16 such that the ring impeller 18 rotates with the shaft 16.

A bottom 20 is mounted within the housing 12. The bottom 20 includes an outlet (not shown) which is in fluid communication with a motor chamber 22 surrounding the motor 14. The bottom 20 includes an opening 24 to allow the shaft 16 to extend therethrough. The ring impeller 18 is attached to a distal end of the shaft 16 such that the bottom 20 is disposed between the ring impeller 18 and the motor 14.

Figure 2:
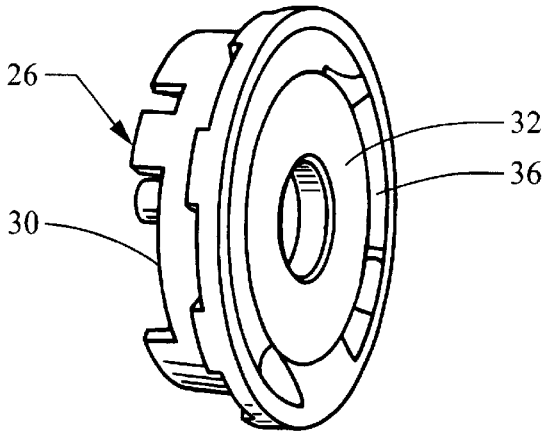
FIG. 2 is a perspective view of a cover of the present invention.
Figure 3:
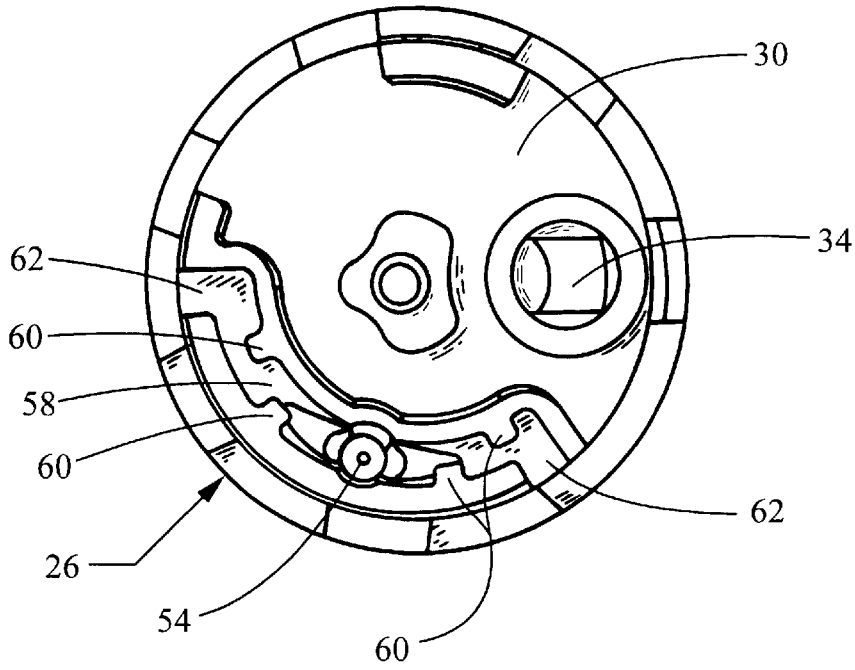
FIG. 3 is a top view of the cover showing a first side of the cover.
Figure 4:
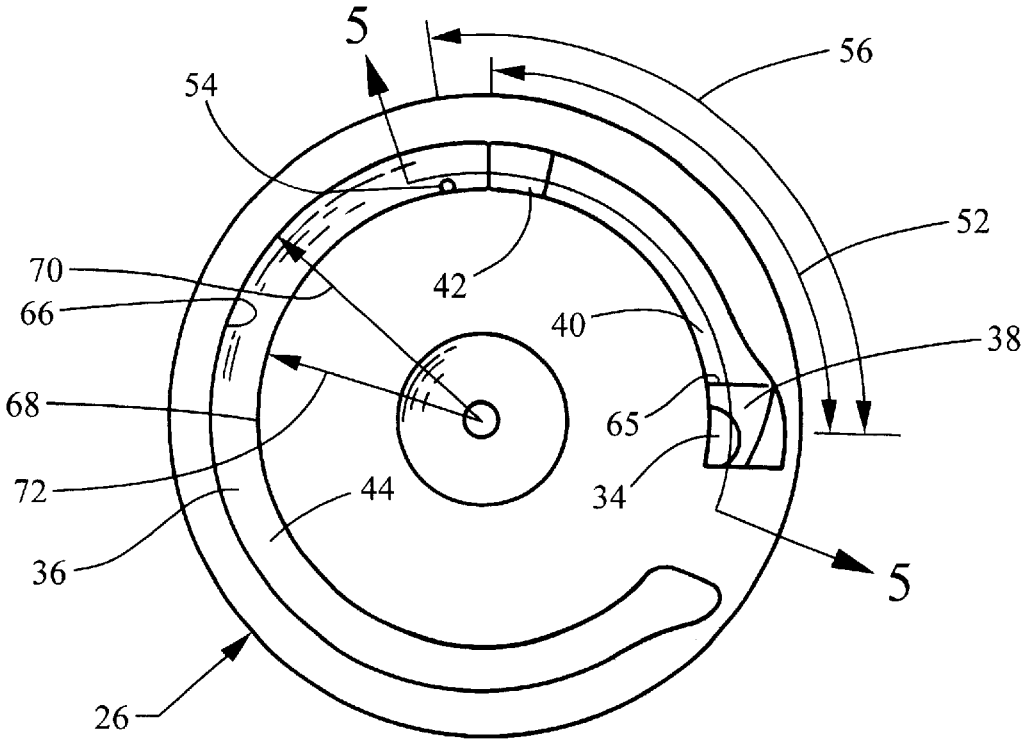
FIG. 4 is a bottom view of the cover showing a second side of the cover.

A cover 26 is mounted on an end of the housing 12 and is attached to the bottom 20. The ring impeller 18 is enclosed between the cover 26 and the bottom 20 within a pumping chamber 28 defined by the cover 26 and the bottom 20. The outlet of the bottom 20 allows fuel to flow from the pumping chamber 28 to the motor chamber 22. Referring to FIGS. 2 through 4, the cover includes a first side 30 and a second side 32. The first side 30 has a fuel inlet orifice 34 which is in fluid communication with the pumping chamber 22 to allow fuel to flow into the pumping chamber 22. The second side 32 of the cover 26 defines a sealing surface that is adapted for sealed engagement with the bottom 20.

A flow channel 36 is formed within the second side 32 of the cover 26. The flow channel 36 forms one side of the pumping chamber 22. The inlet orifice 34 allows fuel to enter the fuel pump 10 into the flow channel 36. The flow channel 36 includes four discrete sections. A first section defines an inlet 38, a second section defines a ramp 40, a third section defines a ramp end 42 and a fourth section defines a main channel 44.

Figure 5:
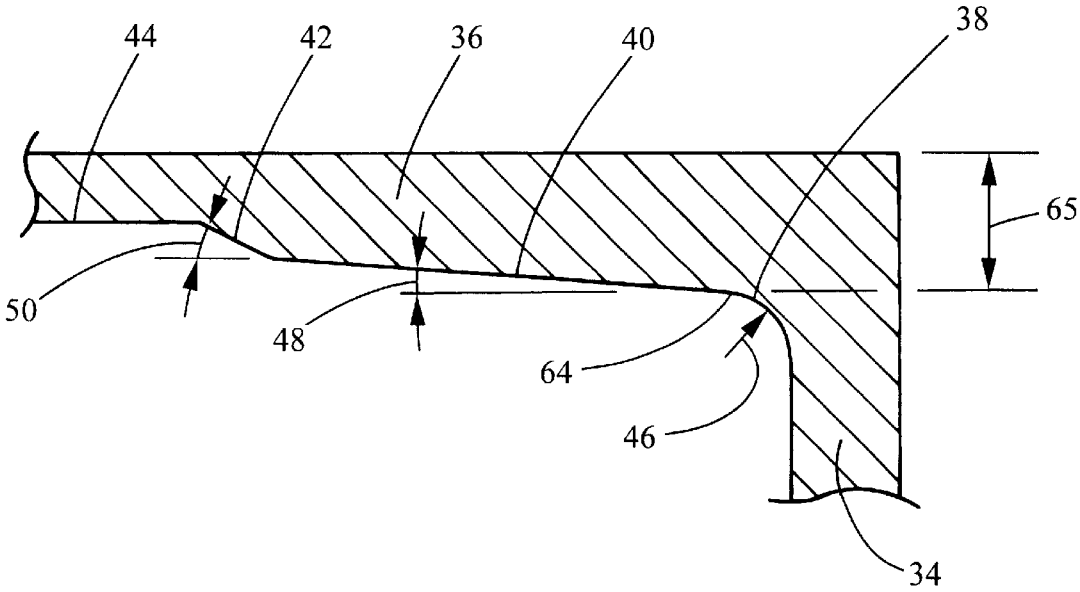
FIG. 5 is a sectional view of a portion of FIG. 4 indicated by line 5—5 of FIG. 4.

Referring to FIG. 5, the inlet 38 has a smooth curved profile. The curved profile has a radius 46 that is preferably at least 2 millimeters. Preferably, the radius 46 of the curved profile is between about 3 millimeters and about 4 millimeters.

The ramp 40 extends from the inlet 38 at an angle 48 relative to the second side 32 and connects the inlet 38 to the ramp end 42. The ramp end 42 extends from the ramp 40 at an angle 50 relative to the second side 32 and connects the ramp 40 to the main channel 44. The angle 48 of the ramp 40 relative to the second side 32 is less than seven degrees and the angle 50 of the ramp end 42 relative to the second surface 32 is between about 10 degrees and about 20 degrees. Preferably, the angle 48 of the ramp 40 relative to the second surface 32 is about 5 degrees.

The total length of the inlet 38, the ramp 40 and the ramp end 42 is defined by an arc 52 extending from the inlet orifice 34. The arc 52 extends from the inlet orifice 34 a distance between about 40 degrees and about 90 degrees. Preferably, the arc 52 extends about 70 degrees. The relative lengths of the inlet 38, the ramp 40 and the ramp end 42 relative to the total length are about 10% inlet 38, about 70% ramp 40 and about 20% ramp end 42.

The main channel 44 of the cover 26 includes a vapor purge hole 54 extending from the flow channel 36 through the cover 26. The vapor purge hole 54 allows fluid communication between the flow channel 36 and the first side 30 of the cover 26. The vapor purge hole 54 is located a distance from the inlet orifice 34 defined by an arc 56 extending between about 90 degrees and about 120 degrees from said inlet orifice 34. Preferably, the arc 56 extends about 110 degrees. The diameter of the vapor purge hole 54 is between about 1 millimeter and about 2 millimeters. Preferably, the diameter of the vapor purge hole 54 is about 1.25 millimeters.

Referring again to FIG. 3, the first side of the cover 26 also includes an energy dissipation channel 58 in fluid communication with the vapor purge hole 54. The energy dissipation channel 58 includes a plurality of dissipation dams 60 adapted to dissipate the energy of the purged flow and at least one opening 62 adapted to guide the purged fuel for smooth flowing out with lower noise. A more detailed description of the vapor purge hole 54 and the energy dissipation channel 58 appears in U.S. Pat. No. 5,330,319 which is assigned to the assignee of the present application and is hereby incorporated by reference into the present application.

Referring again to FIG. 5, the flow channel 36 includes a junction 64 where the inlet 38 and the ramp 40 meet. The junction 64 is located at a depth 65 from the second side 32 of the cover 26 of between about 3 millimeters and about 6 millimeters. Preferably, the junction 64 is located at a depth of about 5 millimeters from the second side 32 of the cover 26.

The flow channel 36 has a width which is defined by an outer wall 66 and an inner wall 68. The diameter 70 of the outer wall 66 is the same as the outer diameter of the vanes on the ring impeller 18. The diameter 72 of the inner wall 68 is less than about 1.5 millimeters smaller than the diameter of the vanes roots on the ring impeller 18. Preferably, the diameter 72 of the inner wall 68 is about 1 millimeter less than the diameter of the vane roots on the ring impeller 18.

The foregoing discussion discloses and describes one preferred embodiment of the invention. One skilled in the art will readily recognize from such discussion, and from the accompanying drawings and claims, that changes and modifications can be made to the invention without departing from the true spirit and fair scope of the invention as defined in the following claims. The invention has been described in an illustrative manner, and it is to be understood that the terminology which has been used is intended to be in the nature of words of description rather than of limitation.

We claim:

1. A cover for a fuel pump having a ring impeller comprising:

a first side having a fuel inlet orifice and a second side defining a sealing surface and having a flow channel formed therein, said fuel inlet orifice extending through said cover in fluid communication with said flow channel;

said flow channel having a first section defining an inlet, a second section defining a ramp, a third section defining a ramp end and a fourth section defining a main channel, a total length of said inlet, said ramp and said ramp end being defined by an arc extending between about 40 degrees and about 90 degrees from said inlet orifice;

said inlet having a length that is about 10% of the total length of said arc, said ramp having a length that is about 70% of the total length of said arc, and said ramp end having a length that is about 20% of the total length of said arc;

said inlet having a smooth curved profile, said ramp extending from said inlet at an angle relative to said sealing surface and connecting said inlet to said ramp end and said ramp end extending from said ramp at an angle relative to said second side and connecting said ramp to said main channel.

2. The cover of claim 1 wherein said main channel includes a vapor purge hole.

3. The cover of claim 2 wherein said vapor purge hole is located a distance from said inlet orifice, said distance defined by an arc extending between about 90 degrees and about 120 degrees from said inlet orifice.

4. The cover of claim 1 wherein said inlet has a smooth curved profile having a radius of at least 2 millimeters.

5. The cover of claim 4 wherein said inlet has a smooth curved profile having radius between about 3 millimeters and about 4 millimeters.

6. The cover of claim 1 including a junction where said inlet and said ramp meet, said junction being located at a depth from said second side between about 3 millimeters and about 6 millimeters.

7. The cover of claim 6 wherein said junction is located at a depth of about 5 millimeters from said second side.

8. The cover of claim 1 wherein said ramp extends from said inlet at an angle of less than seven degrees relative to said second side and said ramp end extends from said ramp at an angle between about 10 degrees and about 20 degrees relative to said second side.

9. The cover of claim 8 wherein said ramp extends from said inlet at an angle of about 5 degrees relative to said second side.

10. A fuel pump comprising:

a pump housing;

a motor positioned within paid housing and being adapted to rotate a shaft protruding therefrom;

a ring impeller attached to said shaft;

a bottom mounted to said housing and having an outlet in fluid communication with a motor chamber surrounding said motor, said bottom having an opening for allowing said shaft to pass through wherein said impeller is attached to said shaft with said bottom disposed between said impeller and said motor;

a cover mounted on an end of said housing and attached to said bottom with said ring impeller enclosed between said cover and said bottom;

said cover including a first side having a fuel inlet orifice and a second side defining a sealing surface and having a flow channel formed therein, said inlet orifice extending through said cover in fluid communication with said flow channel;

said flow channel having a first section defining an inlet, a second section defining a ramp, a third section defining a ramp end and a fourth section defining a main channel, a total length of said inlet, said ramp and said ramp end being defined by an arc extending between about 40 degrees and about 90 degrees from said inlet orifice;

said inlet having a length that is about 10% of the total length of said arc, said ramp having a length that is about 70% of the total length of said arc, and said ramp end having a length that is about 20% of the total length of said arc;

said inlet having a smooth curved profile, said ramp extending from said inlet at an angle relative to said second side and connecting said inlet to said ramp end and said ramp end extending from said ramp at an angle relative to said second side and connecting said ramp to said main channel.

11. The fuel pump of claim 10, wherein said main channel includes a vapor purge hole.

12. The fuel pump of claim 11 wherein said vapor purge hole is located a distance from said inlet orifice, said distance defined by an arc extending between about 90 degrees and about 120 degrees from said inlet orifice.

13. The fuel pump of claim 10 wherein said inlet has a smooth curved profile having a radius of at least 2 millimeters.

14. The fuel pump of claim 13 wherein said inlet has a smooth curved profile having a radius between about 3 millimeters and about 4 millimeters.

15. The fuel pump of claim 10 including a junction where said inlet and said ramp meet, said junction being located at a depth from said second side between about 3 millimeters and about 6 millimeters.

16. The fuel pump of claim 15 wherein said junction is located at a depth of about 5 millimeters from said second side.

17. The fuel pump of claim 10 wherein said ramp extends from said inlet at an angle of less that seven degrees relative to said second side and said ramp end extends from said ramp at an angle between about 10 degrees and about 20 degrees relative to said second side.

18. The fuel pump of claim 17 wherein said ramp extends from said inlet at an angle of about 5 degrees relative to said second side.

19. A fuel pump comprising:

a pump housing;

a motor positioned within said housing and being adapted to rotate a shaft protruding therefrom;

a ring impeller attached to paid shaft;

a bottom mounted to said housing and having an outlet in fluid communication with a motor chamber surrounding said motor, said bottom having an opening for allowing said shaft to pass through wherein said impeller is attached to said shaft with said bottom disposed between said impeller and said motor;

a cover mounted on an end of said housing and attached to said bottom with said ring impeller enclosed between said cover and said bottom;

said cover including a first side having a fuel inlet orifice and a second side defining a sealing surface and having a flow channel formed therein, said inlet orifice extending through said cover in fluid communication with said flow channel;

said flow channel having a first section defining an inlet, a second section defining a ramp, a third section defining a ramp end and a fourth section defining a main channel;

said inlet having a smooth curved profile, said ramp extending from said inlet at an angle of less than seven degrees relative to said second side and connecting said inlet to said ramp end and said ramp end extending from said ramp at an angle between about ten degrees and about twenty degrees relative to said second side and connecting said ramp to said main channel.

20. The fuel pump of claim 19 wherein said main channel includes a vapor purge hole.

21. The fuel pump of claim 20 wherein said vapor purge hole is located a distance from said inlet orifice, said distance defined by an arc extending between about 90 degrees and about 120 degrees from said inlet orifice.

22. The fuel pump of claim 19 wherein the total length of said inlet, said ramp and said ramp end is defined by an arc extending between about 40 degrees and about 90 degrees from said inlet orifice.

23. The fuel pump of claim 22 wherein said arc extends about 70 degrees.

24. The fuel pump of claim 23 wherein the length of said inlet is about 10% of the total length of said arc, said ramp is about 70% of the total length of said arc and said ramp end is about 20% of the total length of said arc.

25. The fuel pump of claim 19 wherein said inlet has a smooth curved profile having a radius of at least 2 millimeters.

26. The fuel pump of claim 25 wherein said inlet has a smooth curved profile having a radius of between about 3 millimeters and about 4 millimeters.

27. The fuel pump of claim 19 including a junction where said inlet and said ramp meet, said junction being located at a depth from said second side between about 3 millimeters and about 6 millimeters.

28. The fuel pump of claim 27 wherein said junction is located at a depth of about 5 millimeters from said second side.

29. The fuel pump of claim 19 wherein said ramp extends from said inlet at an angle of about 5 degrees relative to said second side.

30. A cover for a fuel pump having a ring impeller comprising:

a first side having a fuel inlet orifice and a second side defining a sealing surface and having a flow channel formed therein, said fuel inlet orifice extending through said cover in fluid communication with said flow channel;

said flow channel having a first section defining an inlet, a second section defining a ramp, a third section defining a ramp end and a fourth section defining a main channel;

said inlet having a smooth curved profile, said ramp extending from said inlet at an angle of less than seven degrees relative to said second side and connecting said inlet to said ramp end and said ramp end extending from said ramp at an angle between about ten degrees and about twenty degrees relative to said second side and connecting said ramp to said main channel.

31. The cover of claim 30 wherein said main channel includes a vapor purge hole.

32. The cover of claim 31 wherein said vapor purge hole is located a distance from said inlet orifice, said distance defined by an arc extending between about 90 degrees and about 120 degrees from said inlet orifice.

33. The cover of claim 30 wherein the total length of said inlet, said ramp and said ramp end is defined by an arc extending between about 40 degrees and about 90 degrees from said inlet orifice.

34. The cover of claim 33 wherein said arc extends about 70 degrees.

35. The cover of claim 34 wherein the length of said inlet is about 10% of the total length, said ramp is about 70% of the total length and said ramp end is about 20% of the total length.

36. The cover of claim 30 wherein said inlet has a smooth curved profile having a radius of at least 2 millimeters.

37. The cover of claim 36 wherein said inlet has a smooth curved profile having a radius between about 3 millimeters and about 4 millimeters.

38. The cover of claim 30 including a junction where said inlet and said ramp meet, said junction being located at a depth from said second side between about 3 millimeters and about 6 millimeters.

39. The cover of claim 38 wherein said junction is located at a depth of about 5 millimeters from said second side.

40. The cover of claim 30 wherein said ramp extends from said inlet at an angle of about 5 degrees relative to said second surface.

* * * * *

UNITED STATES PATENT AND TRADEMARK OFFICE

CERTIFICATE OF CORRECTION

PATENT NO. : 6,655,909 B2
DATED : December 2, 2003
INVENTOR(S) : DeQuan Yu et al.

It is certified that error appears in the above-identified patent and that said Letters Patent is hereby corrected as shown below:

Column 3,
Line 66, insert -- a -- before “radius”.

Column 5,
Line 16, delete “paid” and substitute -- said -- in its place.

Signed and Sealed this

Twenty-second Day of June, 2004

JON W. DUDAS
*Acting Director of the United States Patent and Trademark Office*